US005169022A

United States Patent [19]

Elliott et al.

[11] Patent Number: 5,169,022

[45] Date of Patent: Dec. 8, 1992

[54] CIRCULAR PAINT TRAY

[76] Inventors: Raymond W. Elliott, 8 Alonna Street, Bowmanville, Ontario, Canada, L1C 3P6; Kevin J. O'Brien, 799 Rodney Court, Oshawa, Ontario, Canada, L1G 6V6

[21] Appl. No.: 624,213

[22] Filed: Dec. 10, 1990

Related U.S. Application Data

[63] Continuation-in-part of Ser. No. 500,993, Mar. 23, 1990, abandoned.

[30] Foreign Application Priority Data

Mar. 1, 1990 [CA] Canada ..... 2011216

[51] Int. Cl.[5] ..... B44D 3/00

[52] U.S. Cl. ..... 220/570; D6/512; 15/257.06; 220/574

[58] Field of Search ..... D7/500, 543, 549; 15/257.06; 206/557, 229; 220/90, 570, 574, 633; D6/512

[56] References Cited

U.S. PATENT DOCUMENTS

| | | | |
|---|---|---|---|
| D. 58,038 | 5/1921 | McInerney . | |
| D. 97,442 | 11/1935 | Slobodkin | 220/574 |
| 226,665 | 4/1880 | Love | 220/574 |
| D. 254,482 | 3/1980 | Bell | D9/290 |
| 1,251,549 | 1/1918 | McDonald et al. . | |
| 1,589,558 | 6/1926 | Reizenstein | 220/574 |
| 2,664,722 | 1/1954 | Barr | 220/574 |
| 2,795,942 | 1/1955 | Harris | 65/15 |
| 3,395,828 | 8/1968 | Schnabel | 220/90 |
| 3,622,036 | 11/1971 | Bongaerts | 220/574 |
| 3,688,943 | 9/1972 | Brown | 220/90 |
| 3,901,256 | 8/1975 | Habostad | 134/138 |
| 3,945,527 | 3/1976 | Pylant | 220/90 |
| 3,947,135 | 3/1976 | Hawk | 401/121 |
| 3,980,213 | 9/1976 | Ramsay | 222/485 |
| 3,989,158 | 11/1976 | Florian | 220/574 |
| 4,150,763 | 4/1979 | Simpson | 220/90 |
| 4,225,064 | 9/1980 | Westcott | 222/569 |

FOREIGN PATENT DOCUMENTS

| | | | |
|---|---|---|---|
| 1085347 | 9/1980 | Canada . | |
| 1216258 | 1/1987 | Canada . | |
| 0334435 | 12/1903 | France | 220/574 |
| 397802 | 5/1909 | France | 220/20 |
| 1419869 | 10/1965 | France | 220/20 |
| 0009425 | of 1886 | United Kingdom | 220/574 |
| 4874 | of 1892 | United Kingdom | 220/70 |
| 0000177 | of 1896 | United Kingdom | 220/574 |
| 1745 | of 1908 | United Kingdom | 220/20 |

*Primary Examiner*—Jimmy G. Foster
*Attorney, Agent, or Firm*—Nixon & Vanderhye

[57] ABSTRACT

A paint tray for applying paint to a roller, said tray comprising a circular well of sufficient diameter to receive a paint roller within it, a spreading surface sloping slightly upwardly and outwardly from said well to a circular lip and a support means to support the tray on a flat surface.

2 Claims, 2 Drawing Sheets

CIRCULAR PAINT TRAY

This application is a CIP of Ser. No. 500,993, filed Mar. 23, 1990, now abandoned.

FIELD OF THE INVENTION

This invention relates to the field of apparatus for painting and, in particular, relates to a circular paint tray for use with a roller.

PRIOR ART

Ordinarily when one is painting with a roller, for example when applying paint to the walls and ceiling of a room, one has a rectangular paint tray which is sloped downwardly from front to back which contains an amount of paint. The roller is rolled down the slope into the paint and back and forth along the slope in order to evenly distribute the paint over the roller, then the roller is applied to the walls to roll the paint onto the walls. As one moves around the room, one must slide the rectangular paint tray from position to position in order to direct the front of the paint tray towards the painter. The continual movement of the paint tray wastes time since the painter must interrupt the painting operation, put down his tools and then move the paint tray. Furthermore, since the paint tray contains paint, there is a possibility of spilling paint onto the floor of the room being painted.

An example of a rectangular type of paint tray is found in U.S. Pat. No. 3,947,135 entitled "Paint Tray", which issued to Gagfry D. Hawk, Mar. 30, 1976.

Other approaches to the problem of handling paint have involved adapting devices to the paint can itself in order to permit the painter to dip the roller directly into the paint can and to remove excess paint from the roller by some means attached to or floating within the paint can. Examples of such devices are found in Canadian patent 1,216,258 entitled "Device for Scraping Off Liquid" which issued Jan. 6, 1987 to L. Rolin; U.S. Pat. No. 4,150,763 entitled "Paint Brush Scraper" which issued Apr. 24, 1979 to C. L. Simpson: Canadian patent 1,085,347 entitled "Gutter Apparatus for Collecting Spills from Paint Can" which issued Sep. 9, 1980 to M. E. Martin; U.S. Pat. No. 3,945,527 entitled "Paint Brush Wiping Device" which issued Mar. 23, 1976 to A. A. Pylant; U.S. design Pat. No. 254,482 entitled "Pouring Attachment for Paint Cans" which issued Mar. 18, 1980 to C. J. Bell; U.S. Pat. No. 4,225,064 entitled "Painter's Accessory" which issued Sep. 30, 1980 to R. Westcott; U.S. Pat. No. 3,395,828 entitled "Paint Can Attachment Device" which issued to F. C. Schnabel on Aug. 6, 1968; U.S. Pat. No. 3,688,943 entitled "Rim Protector and Painting Implement Container for Paint Cans" which issued Sep. 5, 1972 to D. C. Brown; and U.S. Pat. No. 3,980,213 entitled "Covers for Paint Cans" which issued Sep. 14, 1976 to R. A. Ramsay.

The idea of attaching a device to the paint can itself does not avoid the necessity of moving the apparatus around the room. Further, attaching devices to a paint can presents a greater likelihood of spillage of the entire can of paint during the painting operation.

The present invention takes a different approach to the solution to the problem.

GENERAL DESCRIPTION OF THE INVENTION

The present invention comprises a paint tray which is round in plan view, having a centrally disposed well and inclined surfaces extending from the perimeter of the well to the outside perimeter of the paint tray, said outside perimeter being supported by one or move flanges extending downwardly.

The paint tray of this invention may be used for applying paint to a roller. The tray has a circular well of sufficient diameter to receive a paint roller within it, a spreading surface sloping slightly upwardly and outwardly from said well to a circular lip and a support means to support the tray on a flat surface.

In particular embodiments, the paint tray of this invention will comprise:

a circular well having a substantially flat base surrounded by a circumferential side wall to hold a quantity of paint, a spreading surface sloping from a top portion of the side wall upwardly and outwardly at a small angle to the horizontal for a distance greater than the circumference of the roller to permit the roller to be rolled over said surface to spread the paint over the roller, a circular lip surrounding the spreading surface to reduce the probability of spillage of paint from the spreading surface, and support means of one or more flanges depending from positions near the lip to support the paint tray from tipping in any direction.

The support means may be a single continuous flange depending from the lip around the paint tray and terminating in the plane of the base of the well to permit the paint tray to be supported on a flat surface by the base and the flange.

In preferred embodiments of the invention, the inclined surface between the perimeter of the paint well and the outside perimeter of the tray will have raised ribs to assist in turning the roller as it is rubbed back and forth along the inclined surface.

By means of the present invention, the painter is able to place the paint tray in the centre of a room to be painted, to fill the well with paint and to commence painting from any position within the room. As the painter moves about the room, the paint tray, being circular, always presents to him a means of direct entry into the paint well and a surface upon which to roll the paint to evenly distribute the paint over the roller without having to turn the paint tray.

FIGURES

In the figures which illustrate the preferred embodiment of this invention,

DESCRIPTION OF PREFERRED EMBODIMENT

In the Figures, like numerals indicate like elements.

Figure 1:
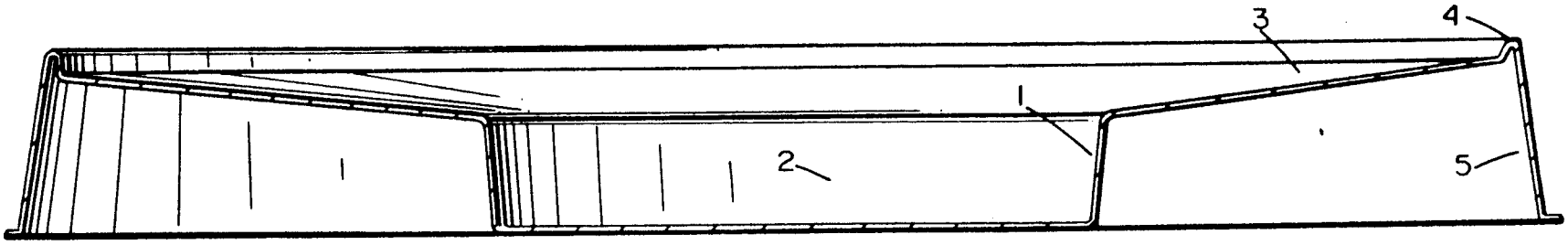
FIG. 1 is a cross-sectional view of the paint tray taken through its centre.

As illustrated in FIG. 1, the preferred embodiment of the paint tray of this invention includes a centrally disposed well (2) surrounded by perimeter side wall (1) adapted to hold paint and to receive a paint roller within it to wet the roller with paint. A sloping surface (3) extends from the perimeter side wall (1) to an outside lip (4) which extends about the perimeter of the paint tray. A flange (5) depends from the lip portion and is adapted to support the sloping surface (3) and the lip (4) portions of the paint tray when the roller is placed against them.

Figure 2:
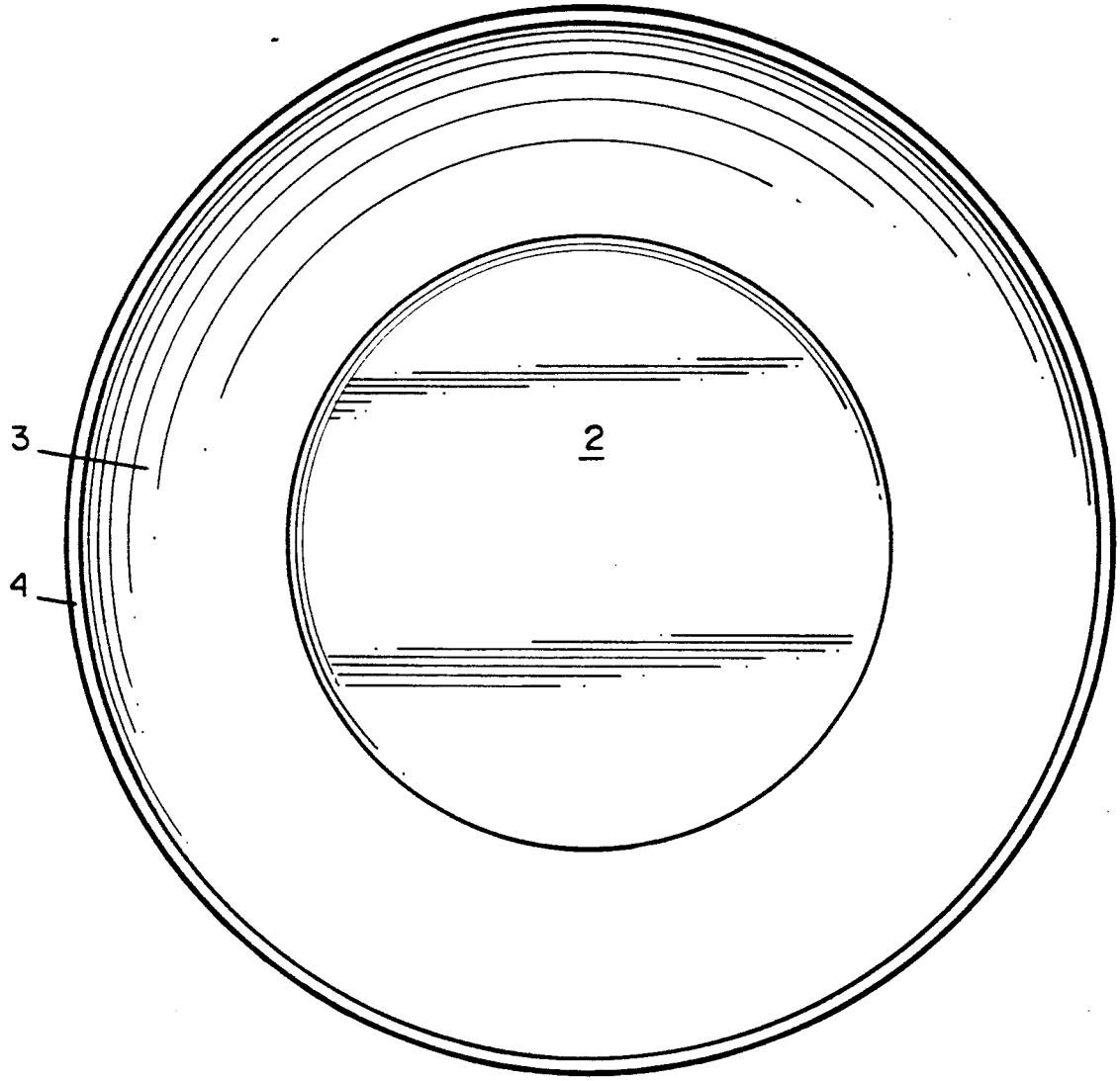
FIG. 2 is a top or plan view of the paint tray.

As illustrated in FIG. 2, the surface presented to the painter by the paint tray is circular and therefore readily accessible from any angle.

Figure 3:
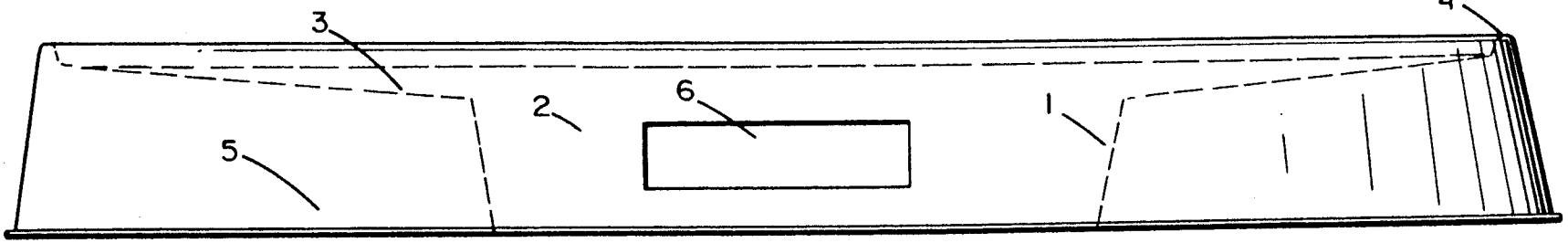
FIG. 3 is side view.

As illustrated in FIG. 3, the supporting flange (5) depends from the lip (4) to a level approximately equal to the level of the base of the well so that the paint tray sits securely and flatly upon a floor. An opening (6) may be provided in the flange (5) to allow one to grasp the paint tray to pick it up.

In operation the painter may approach the paint tray from any angle and dip the roller in the well (2), apply the roller to the sloping surface (3) to roll it back and forth thereby spreading the paint evenly over the roller and then may apply the roller to the wall to be painted. The lip (4) prevents paint from dripping from the sloping surface (3) unto the floor. By reason of the slope on surface (3) any paint which drips off the roller will flow back into the well (2).

What is claimed is:

1. A paint tray for applying paint to a roller comprising a circular well having a substantially flat base surrounded by a circumferential side wall to hold a quantity of paint, a spreading surface sloping from a top portion of the side wall upwardly and outwardly at a small angle to the horizontal plane for a distance greater than the circumference of the roller to permit the roller to be rolled over said surface to spread the paint over the roller, a circular lip protruding upwardly from said small angle and surrounding the spreading surface to reduce the probability of spillage of paint from the spreading surface, and support means of one or more flanges depending from positions near the lip to support the paint tray from tipping in any direction.

2. The paint tray of claim 1 in which the support means is a single continuous flange depending from the lip around the paint tray and terminating in the plane of the base of the well to permit the paint tray to be support on a flat surface by the base and the flange.

* * * * *